US005401092A

United States Patent [19]

Ady

[11] Patent Number: 5,401,092

[45] Date of Patent: Mar. 28, 1995

[54] DESK HAVING AN AIR-COOLED AND DUST FREE COMPARTMENT FOR A PRINTER

[75] Inventor: Aharon Ady, Haifa, Israel

[73] Assignee: Oranim Silencer Ltd., Kiriiat Bialik, Israel

[21] Appl. No.: 965,214

[22] Filed: Oct. 23, 1992

[30] Foreign Application Priority Data

Nov. 6, 1991 [IL] Israel ..... 099972

[51] Int. Cl.[6] ..... A47B 81/00

[52] U.S. Cl. ..... 312/223.2; 312/236

[58] Field of Search ..... 312/223.2, 196, 194, 312/236, 249.9

[56] References Cited

U.S. PATENT DOCUMENTS

| | | | |
|---|---|---|---|
| 4,268,768 | 5/1981 | Beckord | 312/236 |
| 4,493,267 | 1/1985 | Jedziniak | 312/236 |
| 4,626,048 | 12/1986 | Goodlander | 312/223.3 |
| 4,645,275 | 2/1987 | Pucci | 312/223.2 |
| 4,755,009 | 7/1988 | Price | 312/194 |
| 4,766,422 | 8/1988 | Wolters | 312/194 |
| 4,974,915 | 12/1990 | Bussard | 312/236 |
| 4,989,506 | 2/1991 | McCormick | 312/31 |
| 5,017,032 | 5/1991 | Green | 312/223.2 |

FOREIGN PATENT DOCUMENTS 81629 2/1991 Israel .

*Primary Examiner*—Flemming Saether

*Attorney, Agent, or Firm*—Frishauf, Holtz, Goodman & Woodward

[57] ABSTRACT

A desk includes a compartment for a silent printer designed to prevent dirt and dust from entering it. The compartment is in the form of a drawer fitting closely into a stationary portion of the desk and includes of a bottom supporting the printer and a front panel, the front panel fitting closely into the opening of the stationary portion. The drawer is movable to the front of the desk while gliding on horizontal guides on the side walls and on a wheel attached to the front and moving along the floor. A blower with a filter is mounted on the outside of the desk and blows clean air into the compartment. A narrow slot in the desk top serves for passage of the printer output.

7 Claims, 2 Drawing Sheets

DESK HAVING AN AIR-COOLED AND DUST FREE COMPARTMENT FOR A PRINTER

BACKGROUND OF THE INVENTION

The present invention is an improvement over Israeli Patent No. 81629, for a Silencer Desk for Printer.

The silencer desk according to Israeli Patent No. 81629 comprises a stationary part consisting of a top, two side walls, a rear wall and an open top, and a movable part consisting of an upper drawer portion adapted to be withdrawn out of the stationary part through the open front and including a front panel, a horizontal bottom integral with the front panel serving to support the printer, and two superposed shelf portions attached to the underside of the drawer, serving to contain paper for feeding the printer and for receiving the output paper. The front panel fits snugly into the open front in closed state, and a resilient gasket seals the gap between the panel and the open front so as to prevent the noise from the printer to escape to the outside.

The present invention takes into account that the mechanism of printers has been considerably improved since the date of the above Israeli patent (February 1987), and that modern, laser-operated printers are practically noiseless, but are sensitive to dust and dirt and have consequently to be protected against these which would impair their proper functioning.

On the other hand, if the printer is enclosed in a sealed space in order to exclude dirt and dust, it will heat up to an excess temperature, requiring artificial cooling by cool, clean air passing over it. This arrangement has been known in respect of all kinds of printers and the closed space is usually ventilated by a blower blowing filtered fresh air into the space, the heated air being allowed to escape through slots or openings serving for entry and exit of paper.

SUMMARY OF THE INVENTION

The desk of the present invention is designed for a laser-operated printer, or any other silent printers which are provided with cassettes holding the feed paper, either folded or in rolls, and wherein the operator can obtain the output straight from the top of the desk, instead of bending down for collecting it from a lower shelf.

In a preferred embodiment of the invention a desk for a laser-operated printer comprises a stationary part including a top, a rear wall, two side walls and an open front, and a movable part in the form of a drawer adapted to support the printer and to be pulled out of the stationary part by being moved on guides attached to the side walls. The drawer is provided with a front panel fitting snugly into the open front and contains gasket means serving to seal the drawer interior against entry of dust and dirt. The top of the stationary part, in contradistinction to the top of our previous Israeli patent, contains a slot serving for passage of the output paper.

For cooling the printer and the drawer space, a blower is preferably provided in the rear wall which blows fresh air through a filter into the space of the drawer, creating a slight over-pressure, which forces, the heated air out through a slot in the top of the desk, and through the gaps remaining between the stationary and the movable part.

The top of the desk is preferably covered by a transparent sheet of material which also contains the slot for passage of the output paper.

For the sake of accommodating several types of printers it is proposed that in certain embodiments of the desk the two shelves 23 and 24, or at least one of these shelves, be maintained, while in other embodiments these shelves may be completely omitted. It is also proposed that a supporting wheel (20) be provided in order to prevent tilting of the drawer when pulled out for its entire length.

It is obvious that the closure means not only prevents dust and dirt from entering the drawer and the printer, but it also prevents the low-level noise made by the printer from escaping. If the seal around the front panel of the drawer is omitted, care must be taken that a closed fit is maintained.

DETAILED DESCRIPTION OF THE DRAWINGS

Figure 1:
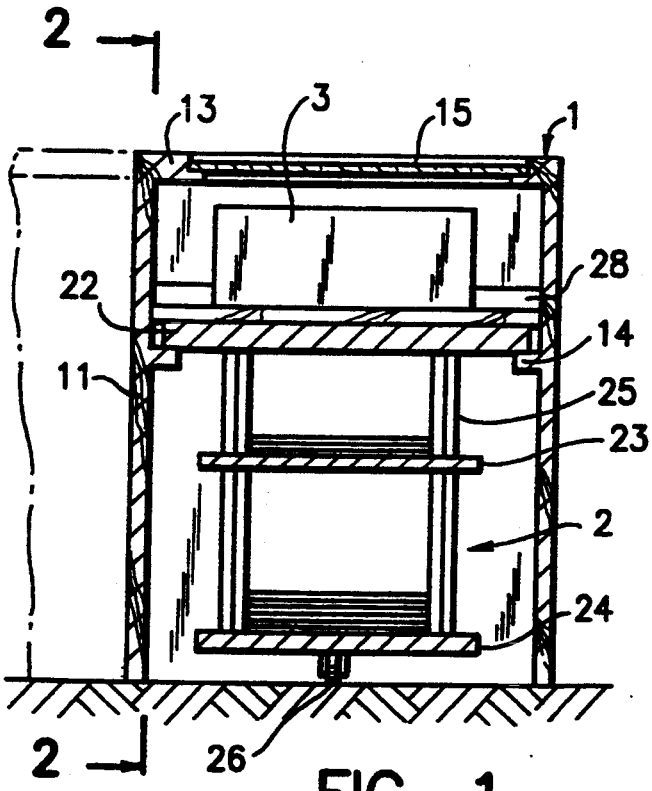
FIG. 1, is a vertical section through the desk provided with a blower and two shelves.
Figure 2:
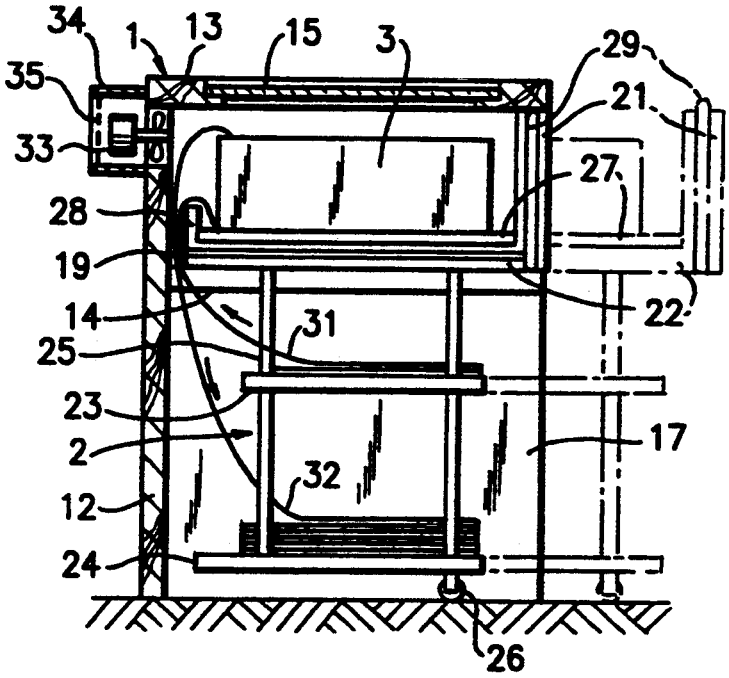
FIG. 2, is a section along line 2—2 of FIG. 1, FIG. 3, shows the desk holding a computer and keyboard.

With reference to FIGS. 1 and 2, a desk for one kind of a laser-operated printer comprises a stationary part 1 and a movable, withdrawable part 2. The stationary part includes two side walls 11, a rear wall 12, a top 13 and an open front 17. Horizontal guides 14 supporting the movable part are fastened to the side walls and are of any known kind generally used with drawers. The top 13 is perforated by a rectangular opening, and a transparent sheet 15 is fastened therein permitting the operator to watch the operation of the printer.

The movable part 2 includes an upper portion in the shape of a drawer comprising a front panel 21 and a bottom 22 the side edges of which cooperate with the horizontal guides 14 on the side walls 11. Two shelves 23 and 24 are suspended from the bottom 22 and are held in rigid parallel alignment by four vertical bars 25. A caster wheel 26 is fastened underneath the front of the lowermost shelf 24 and serves to additionally support the movable part whenever this is pulled out as far as the stops on the guides 14 allow.

A printer 3 is shown in position on the bottom of the drawer, an elastic sheet 27 being provided under the printer 3 to prevent vibrations from being transferred between the desk top and the printer. A narrow slot 19 between the rear of the bottom 22 and the rear wall 12 permits passage for feed paper 31 and output paper 32 from and to the shelves 23 and 24 respectively. A gasket 29 of rubber or plastic surrounds the top and the sides of the front panel 21 in order to seal the drawer against penetration of dust, but it may be omitted in case of a tight fit of the drawer front in the opening of the stationary part.

Entry of dust and dirt into the drawer is prevented by blowing clean air into the space within the drawer by means of an electrically driven blower 33 mounted in a housing 34 which is attached to the rear wall 12 of the desk. The air is cleaned by passing through a filter 35 in the open rear of the housing 34.

Figure 3:
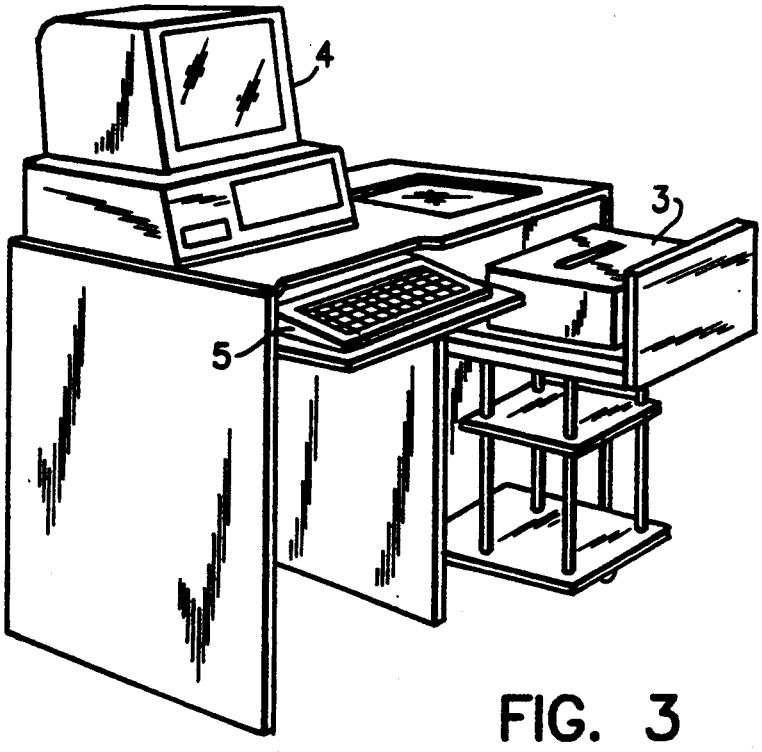

FIGS. 2 and 3 show part of the drawer and the shelves pulled out to the front, as necessary for certain adjustments. (This state is shown in broken lines in FIG. 2).

FIGS. 1 and 3 also illustrate a possible embodiment of a combination of a computer desk with a printer desk of the invention. The combination unit—as shown in FIG. 3—supports a computer 4 on top, a keyboard 5 on an intermediate shelf and encloses the printer 3 as described hereinbefore.

Figure 4:
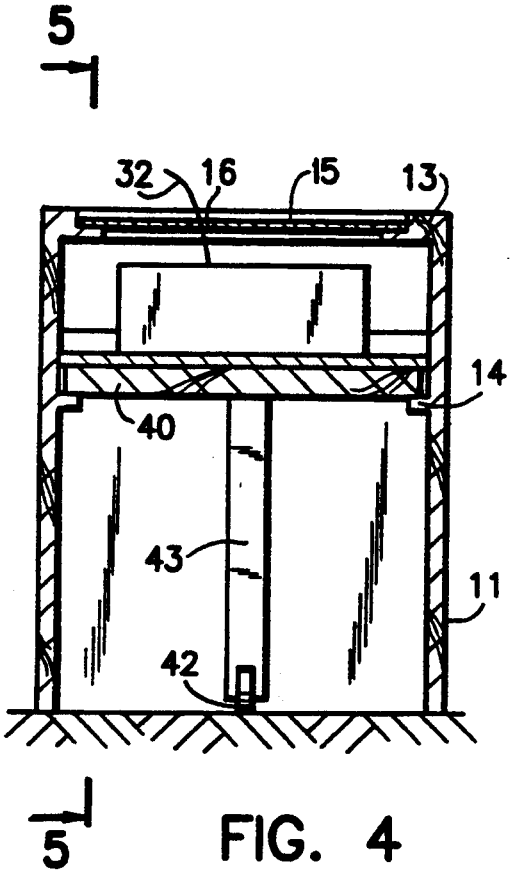
FIG. 4, is a vertical section through a desk provided with a blower and with a slot in the table top.
Figure 5:
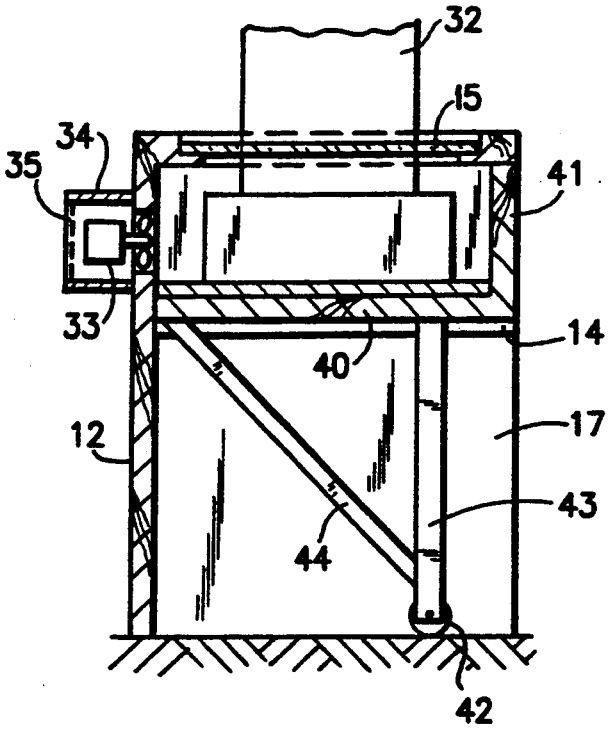
FIG. 5, is a section along line 5—5 of FIG. 4.

FIGS. 4 and 5 illustrate a desk for enclosing a printer 43 of the kind provided with a cassette for holding the feed paper. The stationary part of the desk includes, like the desk of the above described embodiment, a rear wall 12, two side walls 11 each provided with a horizontal drawer guide 14, and an open front 17. The top 13 of the desk is covered by a transparent sheet 15 which is perforated by a slot 16 serving for passage of the output 32 to the outside for ready access of the operator. The printer is positioned on the bottom 40 of a drawer which slides in and out of the desk along the two guides 14 on the side walls, and has a front panel 41 fitting snugly into the open desk front. A blower housing 34 is attached to the rear wall and encloses a blower 33 which draws air from the outside through a filter 35 and blows it into the interior through an opening 36 in the wall. Air escapes out of the drawer mainly through the slot 16 in the top and through crevices remaining between the drawer borders and the desk.

A wheel 42 is attached to the bottom of the drawer by a vertical stay 43 and a diagonal stay 44 and serves for supporting the weight of the drawer and the printer in withdrawn state.

It will be understood that the two embodiments of the desk illustrated and described in the foregoing represent only examples of the various possibilities of enclosing a printer in a desk so as to protect it from dust and dirt, and that variations and modifications may be carried out by a person skilled in the art.

It is, for instance, proposed to make the front panel of the drawer to larger dimensions so as to cover the frontal edges of the side walls and the top of the desk, which will provide a sufficiently tight fit to prevent dust to enter the drawer space.

The printer may be positioned on a porous, resilient sheet 27 or directly on the drawer bottom, the first version being usually preferred with the aim of preventing vibrations from being transferred.

It will be understood that the desk is not only suitable for a laser-operated printer but for any other silent printer, such as an ink jet printer or any other silent design to be developed in the future.

I claim:

1. A desk including a compartment for holding a printer and for preventing dust and dirt from entering said compartment, comprising in combination:

a stationary part including a rear wall, two spaced apart side walls, an open front and a top portion including a sheet of a transparent material, said sheet of transparent material having a narrow paper output slot above and parallel to a paper output slot of a printer mounted in said compartment;

a movable part in the form of a movable drawer slidably mounted in an upper portion of said stationary part on horizontal guides attached to said side walls, said drawer including a bottom member supporting said printer and a front panel in proximity of said top and said side walls in a closed state of said drawer, said front panel of said drawer fitting closely to a top portion of said open front of said stationary part, and a wheel attached to a front portion of said drawer in contact with the floor and arranged to additionally support said drawer when said drawer is in a pulled-out state relative to said stationary part;

a blower connected to said stationary part and arranged to blow clean air into said compartment for increasing air pressure in said compartment to prevent dust from entering said compartment;

a blower housing attached to said rear wall of said stationary part for enclosing said blower; and a filter positioned upstream of said blower for filtering air blown into said compartment by said blower, said blower housing having an opening therein which is closed by said filter;

said filter being an exchangeable filter which is removably mounted in said opening of said blower housing to filter air blown into said compartment.

2. The desk of claim 1, wherein said drawer includes at least one shelf attached to said bottom member for holding feed paper for a printer mounted in said compartment.

3. The desk of claim 2, wherein said at least one shelf is mounted below said bottom member which supports said printer.

4. The desk of claim 1, comprising first and second superposed shelves attached to said bottom member of said drawer for holding printer feed paper and printer output paper, respectively.

5. The desk of claim 1, wherein said first and second shelves are mounted below said bottom member which supports said printer.

6. The desk of claim 1, wherein said front panel comprises a gasket along portions of said front panel which are adjacent to said top portion and to said side walls of said stationary part to seal against said top portion and said side walls.

7. The desk of claim 1, wherein said front panel of said drawer covers, in said closed state, front edges of said top and of said side walls of said stationary part, to prevent dirt and dust from entering said compartment.

* * * * *